US011930948B2

(12) United States Patent
Jakeš et al.

(10) Patent No.: US 11,930,948 B2
(45) Date of Patent: Mar. 19, 2024

(54) FOLDABLE HANGER

(71) Applicant: Boris Jakeš, Bratislava (SK)

(72) Inventors: Boris Jakeš, Bratislava (SK); Zdeněk Jakeš, Brezova pod Bradlom (SK)

(73) Assignee: Boris Jakeš, Bratislava (SK)

( * ) Notice: Subject to any disclaimer, the term of this patent is extended or adjusted under 35 U.S.C. 154(b) by 0 days.

(21) Appl. No.: 18/246,989

(22) PCT Filed: Sep. 29, 2020

(86) PCT No.: PCT/SK2020/050017
§ 371 (c)(1),
(2) Date: Mar. 28, 2023

(87) PCT Pub. No.: WO2022/071895
PCT Pub. Date: Apr. 7, 2022

(65) Prior Publication Data

US 2023/0346147 A1 Nov. 2, 2023

(51) Int. Cl.
*A47G 25/40* (2006.01)

(52) U.S. Cl.
CPC ..... *A47G 25/4015* (2013.01)

(58) Field of Classification Search
CPC ..... A47G 25/40; A47G 25/4015–4038
USPC ..... 223/89–90, 94
See application file for complete search history.

(56) References Cited

U.S. PATENT DOCUMENTS 2,440,637 A 4/1948 Lowe
4,524,890 A 6/1985 Fulton
8,235,261 B1 * 8/2012 Park ..... A47G 25/4023 223/94
9,179,791 B2 * 11/2015 Aspera ..... A47G 25/40
2006/0054646 A1 * 3/2006 Nathanmanna .... A47G 25/4023 223/89
2017/0325614 A1 * 11/2017 Baltz ..... A47G 25/4023

FOREIGN PATENT DOCUMENTS

ES 2755850 A1 4/2020
GB 2335354 A 9/1999
WO 2020122703 A1 6/2020

OTHER PUBLICATIONS

International Search Report and Written Opinion dated Jun. 14, 2021 for international PCT application No. PCT/SK2020/050017.

* cited by examiner

*Primary Examiner* — Nathan E Durham
(74) *Attorney, Agent, or Firm* — Husch Blackwell LLP

(57) ABSTRACT

A foldable hanger may include a body equipped with a hanging element with a firm arm and a movable arm pivotably attached to the body, wherein said body further contains a spike and arresting pin slidable along the spike and exerting a force on the arresting pin, wherein the arresting pin has a shank with a relief snapping to an arresting groove of a sliding-block guide which moves between open and closed positions and contains a guiding slot for a shank of the arresting pin and allowing free movement of a relief of the arresting pin; an arresting groove at the closed end of the guiding slot accommodating the relief; a flexible element exerting a force on the sliding-block guide; sliding-block guide cogs coordinating with cogs at the proximal end of the movable arm; wherein the sliding-block guide is adapted for movement between a closed position and an open position.

17 Claims, 3 Drawing Sheets

FOLDABLE HANGER

CROSS REFERENCE

This application is a U.S. National Phase Application of International Application No. PCT/SK2020/050017 filed on 29 Sep. 2020, the disclosure of which is incorporated herein by reference in its entirety.

TECHNICAL FIELD

The present teaching relates to a foldable hanger for garment and belongs to the field of tools used for garment storage in households, as well as the storage of goods of such characters in texture and fashion industries, in trade networks and the like.

BACKGROUND

Collapsible garment hanger disclosed in WO2020122703A1 comprises a hook for hanging up on a bar or a coat-stand, and a pair of arms with each of arms having a proximal end. The first arm extends from one end of the hook, whereas the second arm is pivotably hinged to the first arm at the proximal ends of the arms. A pair of corresponding female-to-female interlocking elements is disposed on the hook and the second arm (4), respectively, enabling the second arm to be detachably engaged with the hook when the hanger is in use. Disadvantage of this hanger resides in the fact that the second arm remains hanging vertically downwards and obstructs inserting the hanger through the neck openings of cloths.

A clothes hanger according to U.S. Pat. No. 2,440,637A comprises a pair of shoulder pieces of substantially flat material hingedly connected together at their adjacent bottom portions, flat handle portions having inwardly curved sides and projecting upwards from said shoulder pieces and normally abutting each other for limiting pivoting of said shoulder pieces from a substantially horizontal position upwards and by which the shoulder pieces may be pivoted downwards and then upwards with two fingers of one hand engaging against said inwardly curved sides, a projection on one of said handle portions, a leaf spring on the other handle portion and engaging said projection for holding said handle portions latched together, and said leaf spring having side portions projecting from the faces of said handle portions by which the leaf spring may be manually engaged and flexed by another finger of said hand for unlatching said handle portions.

It is disadvantageous that during hanging the cloths it is always necessary to overcome the force of the handle spring and it can be rather fatiguing.

One objective of this present teaching is to provide a hanger removing the above insufficiencies, which using will be easy and convenient and fast for a user.

SUMMARY

Said insufficiencies are considerably remedied by the foldable hanger according to this present teaching, which hanger can be smoothly opened and closed, and comprises a body having a hanging element, one firm arm fixed to the body, and one movable arm pivotably attached to the body.

The body further comprises: a spike, an arresting pin adapted for operation by a user, which arresting pin is mounted on the spike flexibly slidable (for example via a spring) for ensuring slidable movement of the arresting pin along the spike and for creating a continual force pushing the arresting pin off the spike. The arresting pin comprises a shank having a relief at its bottom part, which relief is adapted to fit into an arresting groove of a sliding-block guide. The body further contains a sliding-block guide adapted for operation by a user, which sliding-block guide is movably positioned in the body. The sliding-block guide is adapted for the movement between an open position and a closed position and comprises: a guiding slot for the accommodation of the shank of the arresting pin, a space for free movement of the relief of the arresting pin, which space is formed along the entire length of the guiding slot, the arresting groove adapted for the accommodation of the relief of arresting pin, which groove is formed at the closed end of the guiding slot, the prestressed flexible element for forming the continual pushing force pushing the sliding-block guide into the open position, and sliding-block guide cogs adapted for collaboration with cogs of the movable arm. The movable arm is equipped with cogs at its proximal end, preferably partially circular cogs, said cogs are adapted for the cooperation with the sliding-block guide cogs.

The sliding-block guide is adapted for the movement between the closed position, in which the relief of the arresting pin is locked in the arresting groove of the sliding-block guide and the movable arm is in its standard position, i.e. arranged symmetrically in relation to the firm arm, and the open position, in which the arresting pin is arranged at the entry of the guiding slot and the relief of the arresting pin is out of the arresting groove in the space for free movement and the movable arm is deflected from the standard position.

According to one embodiment the foldable hangar according to this present teaching comprises a firm arm, which can form the integral part of the body.

According to another embodiment the flexible element can be the integral part of the sliding-block guide or it can be attached to the sliding-block guide. The flexible element can be a steel or plastic leaf spring, pushing spring, traction spring or other form of suspension, e.g. a flexible rubber element, etc. The flexible element of the sliding-block guide is prestressed for creating the continual pushing/traction force resulting in pushing/pulling/sliding the sliding-block guide into its open position. The prestressing of the flexible element can be created by (forced) pressing of the flexible element to the body, cover or a support element formed in the body of the hanger in such a way that the flexible element is deformed and thus forming the reverse force.

According to one preferred embodiment the body can be at least partially equipped with a cover. The cover can have an opening for the arresting pin.

The sliding-block guide is arranged in the body in such a way that, in its open position, it is accessible to a finger or to a palm of a user in order to operate the hanger. In the open position the sliding-block guide can extend from the body, be aligned with the body or be slightly sunk in the body, but still accessible to a finger of a user.

According to preferred embodiment the sliding-block guide comprises a side wall, and the sliding-block guide is arranged in to body in such a way that in the closed position the side wall of the sliding-block guide is aligned with the cover and/or the body surface, and in its open position the sliding-block guide partially projects from the body, in order to enable a user to operate the hanger.

According to another preferred embodiment the first and second arms can have shapes adapted for mutual engagement in the open position of the sliding-block guide.

According to the preferred embodiment the arresting pin can contain a head adapted for operation by a user. The arresting pin head can extend from the cover/body via the opening, it can be aligned with the body or cover surfaces, or it can be slightly sunk in the body, but accessible to a finger of a user.

The sliding-block guide can be pivotably positioned in the body, e.g. hanged on a pin or also slidably positioned, e.g. in the groove. In case of pivotable arrangement of the sliding-block guide, both the arresting groove of the sliding-block guide and the sliding-block guide cogs are preferably arch-shaped. In case of slidable arrangement of the sliding-block guide, both the arresting groove and the sliding-block guide cogs are preferably straight.

Advantage of the foldable hanger according to this present teaching resides in the fact that simple pressing of the arresting pin results in the turning of the movable arm from the standard position to the folded position; preferably in such a way that the firm arm is aligned with the movable arm, and the movable arm is blocked in this position without necessity to apply a force or hold the arresting pin during hanging of a cloth to the hanger. The movable arm is in its stable position (under the firm arm) enabling easy and simple threading of the cloth on the hanger without deformation of the neck opening of the cloth. Similarly, upon pushing of the (extended) sliding-block guide inwardly into the body the movable arm is turned back to its standard position and become blocked.

The movable arm is in its folded position, when it is deflected from its standard position. Preferably the movable arm can be deflected in the range of 10° to 180°, more preferably by 70°, 80°, 90°, the most preferably the movable arm is aligned with the firm arm, i.e. it is parallel or almost parallel with the firm arm.

When the user presses the arresting pin the relief of the arresting pin is released from the arresting groove and the prestressed sliding-block guide is turned from its closed position to its open position, while the shank of the arresting pin is moved out of the guiding slot of the sliding-block guide and the sliding-block guide is turned in such a way that it is accessible for the operation by the user. The sliding-block guide can partially extend over the body surface, it can be aligned with the body surface, or it can be slightly sunk into the body. Partial turning of the prestressed sliding-block guide via the gearing formed by the sliding-block guide cogs and the cogs of the movable arm transfer this movement to the movable arm and this arm is turned by the predetermined angel. In preferred embodiment the movable arm is turned to such a position that it is parallel or almost parallel with the firm arm.

Upon pressing the sliding-block guide inwardly into the body by the user the flexible element of the sliding-block guide is deformed into the prestressed position and the sliding-block guide is partially turned from its open position to its closed position resulting in the return of the movable arm to its standard position by the means of the above gearing, and it is blocked in this position. By partial turning the shank of the arresting pin is moved in the guiding slot of the sliding-block guide until engagement of the prestressed arresting pin relief with the arresting groove of the sliding-block guide, which engagement results in the blocking of the sliding-block guide in its closed position, and thus also the movable arm is blocked in its standard position. In turn this closed position of the sliding-block guide is unblocked by the pressing of the arresting pin.

These aspects are merely illustrative of the innumerable aspects associated with the present disclosure and should not be deemed as limiting in any manner. These and other aspects, features and advantages of the present disclosure will become apparent from the following detailed description when taken in conjunction with the referenced drawings.

BRIEF DESCRIPTION OF THE DRAWINGS

Reference is now made more particularly to the drawings, which illustrate the best presently known mode of carrying out the disclosure and wherein similar reference characters indicate the same parts throughout all views.

DETAILED DESCRIPTION

Figure 1A:
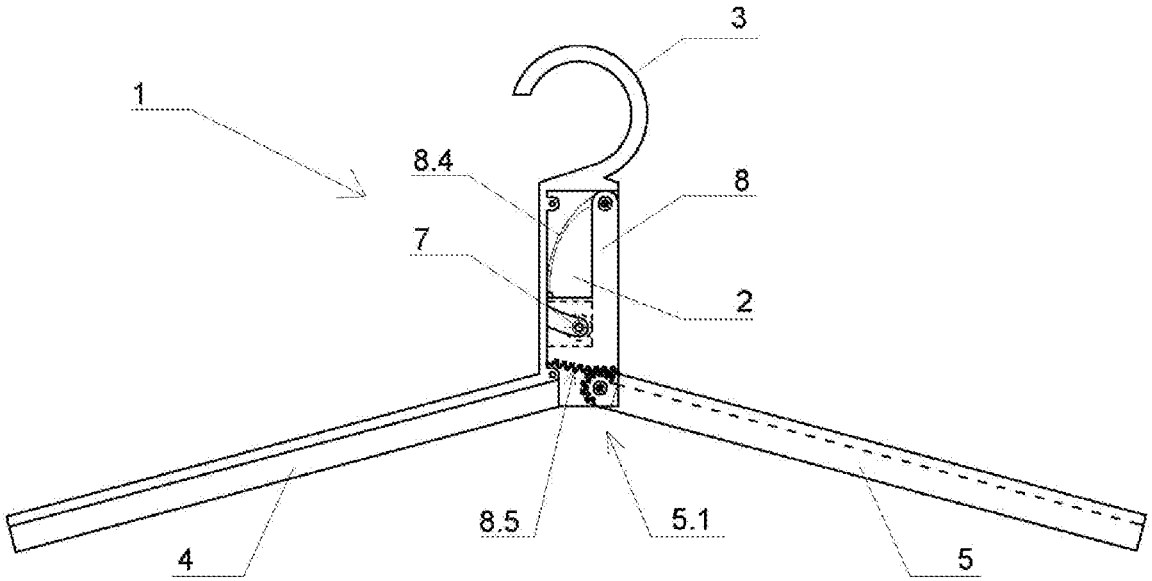
FIG. 1*a* shows an embodiment of a foldable hanger according to the present disclosure with its sliding-block guide in a closed position.

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. The following definitions and non-limiting guidelines must be considered in reviewing the description of the technology set forth herein.

The headings (such as "Background" and "Summary") and sub-headings used herein are intended only for general organization of topics within the present disclosure and are not intended to limit the disclosure of the technology or any aspect thereof. In particular, subject matter disclosed in the "Introduction" may include novel technology and may not constitute a recitation of prior art. Subject matter disclosed in the "Summary" is not an exhaustive or complete disclosure of the entire scope of the technology or any embodiments thereof. Classification or discussion of a material within a section of this specification as having a particular utility is made for convenience, and no inference should be drawn that the material must necessarily or solely function in accordance with its classification herein when it is used in any given composition.

The citation of references herein does not constitute an admission that those references are prior art or have any relevance to the patentability of the technology disclosed herein. All references cited in the "Description" section of this specification are hereby incorporated by reference in their entirety.

The description and specific examples, while indicating embodiments of the technology, are intended for purposes of illustration only and are not intended to limit the scope of the technology. Moreover, recitation of multiple embodiments having stated features is not intended to exclude other embodiments having additional features, or other embodiments incorporating different combinations of the stated features. Specific examples are provided for illustrative purposes of how to make and use the apparatus and systems of this technology and, unless explicitly stated otherwise, are not intended to be a representation that given embodiments of this technology have, or have not, been made or tested.

"A" and "an" as used herein indicate "at least one" of the item is present; a plurality of such items may be present, when possible. "About" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. In addition, disclosure of ranges includes disclosure of all distinct values and further divided ranges within the entire range.

Example 1

Figure 1B:
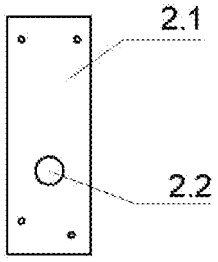
FIG. 1*b* shows a cover of the embodiment of FIG. 1*a*.
Figure 3A:
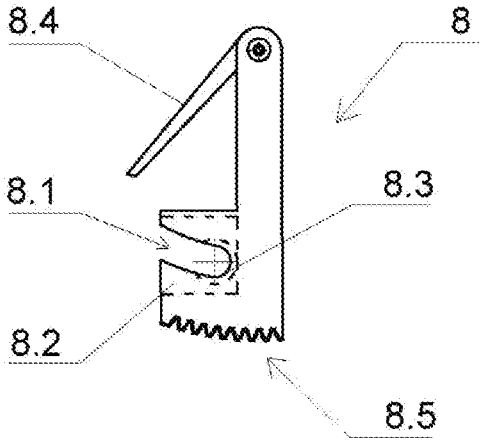
FIGS. 3*a* and 3*b* show an embodiment of a sliding-block guide for a foldable hanger in front and side views, respectively.
Figure 3B:
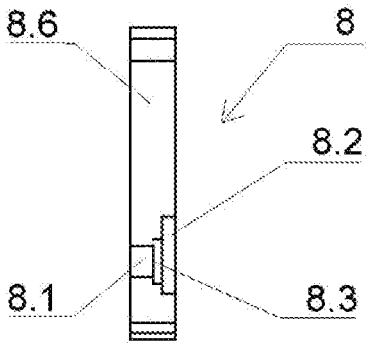
Figure 4:
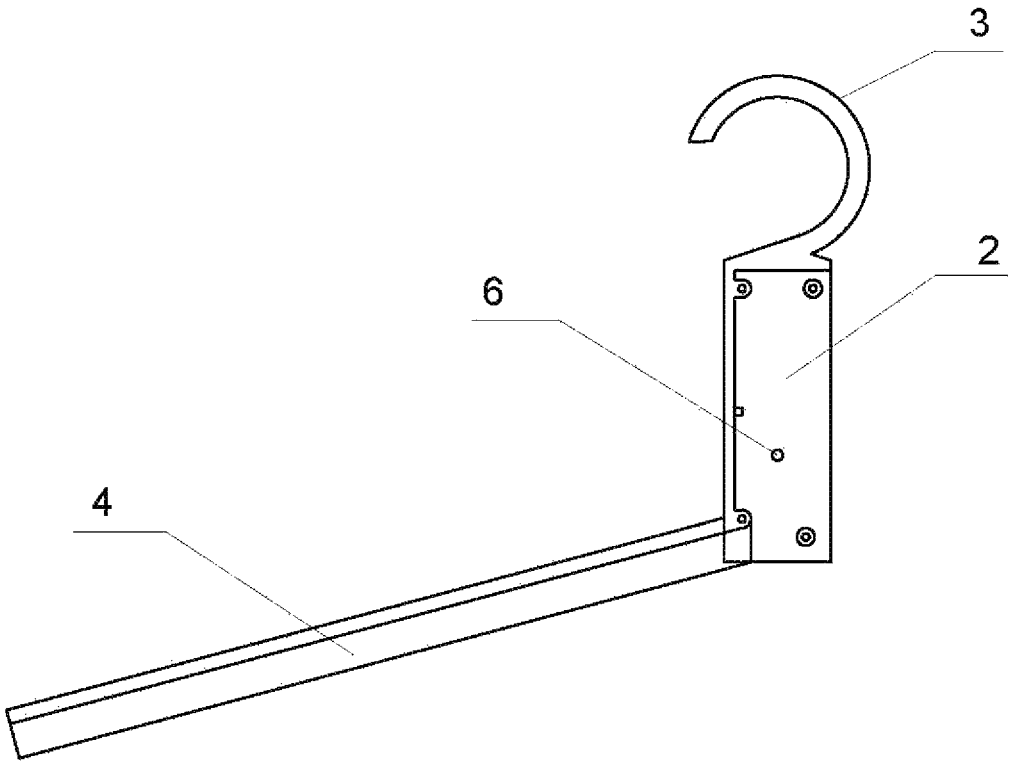
FIG. 4 shows an embodiment of a hanger body for a foldable hanger.
Figure 5:
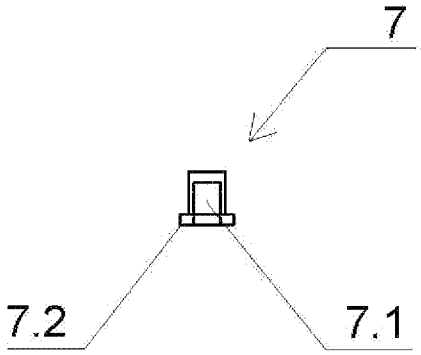
FIG. 5 shows an embodiment of an arresting pin for a foldable hanger.

A foldable hanger 1 according to an embodiment of the present disclosure as shown on FIG. 1*a* may contain a flat body 2 containing a bottom having two side walls. The body has a cover 2.1 with an opening 2.2 for an arresting pin (FIG. 1*b*). The body 2 further contains a hanging element 3 in the form of a hook integrally connected with one side wall of the body 2. At its bottom part the body 2 contains a firm arm 4 and movable arm 5 arranged in a standard position. There is a pin at the bottom of the body 2, approximately in its right top corner, which pin bears a pivotable sliding-block guide 8. The sliding-block guide 8, illustrated also in FIGS. 3A and 3*b*, contains a side wall 8.6 and arch shaped guiding slot 8.1. A space 8.2 is formed around the guiding slot 8.1 at one side 8.2 of the sliding-block guide 8 and there is a circular arresting groove 8.3 formed at the end of the guiding slot 8.1 from the side of the space 8.2 (FIG. 3*b*). In its top part the sliding-block guide 8 is equipped with a prestressed flexible element 8.4, which, in this case, leans on the body side wall. On the side adjacent to the arms 4, 5, the sliding-block guide 8 is equipped with arch-shaped cogs 8.5 having attached the movable arm 5 in a locked position, via partially circular cogs 5.1. This locked position is secured via the position of an arresting pin 7 mounted on a spike 6 on the pushing spring enabling flexible movement along the spike 6. The spike 6 position is visible in FIG. 4. The arresting pin 7 presented in FIG. 5 contains a shank 7.1, and a relief 7.2 in its bottom part, which relief is sunk in a circular arresting groove 8.3 in its standard locked position.

Example 2

Figure 2:
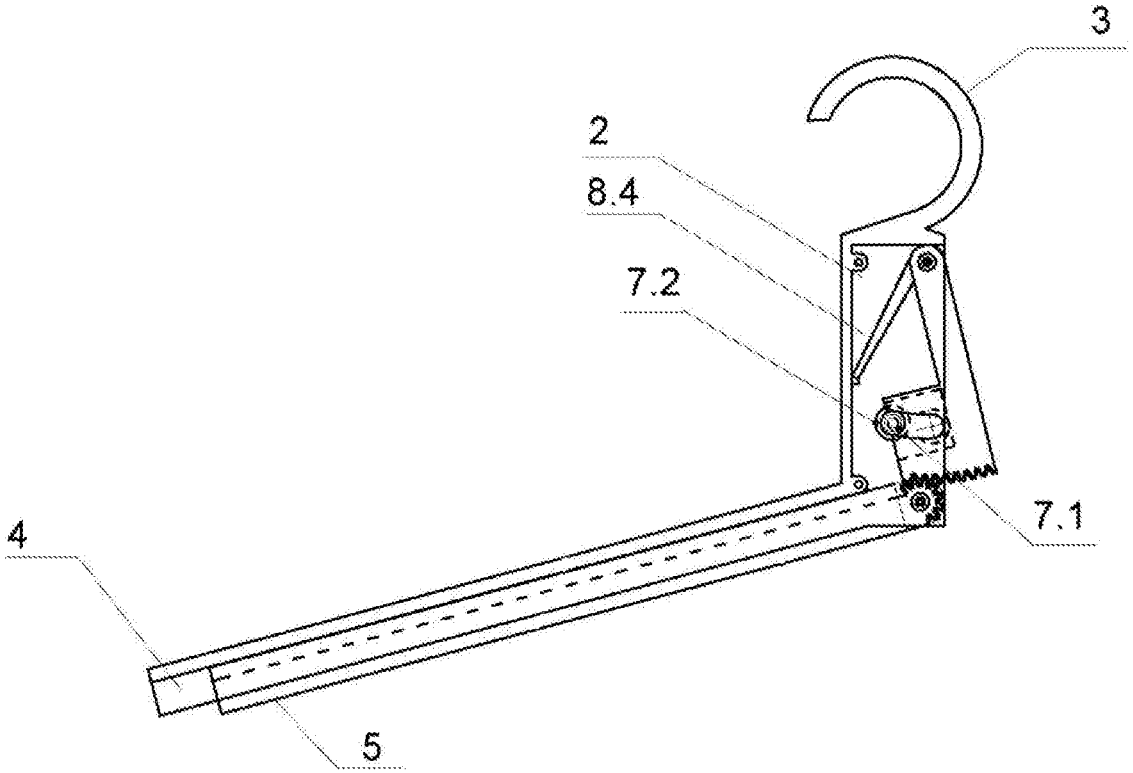
FIG. 2 shows the foldable hanger of FIG. 1*a* with the sliding-block guide in an open position.

Another embodiment of a foldable hanger shown at FIG. 2 consists of similar elements as the hanger of FIG. 1A, but the position of the movable arm 5, the position of the sliding-block guide 8, and the position of the relief 7.2 of the arresting pin 7 are different. The movable arm 5 is present in its folded locked position under the firm arm 4 and on the same side as the firm arm 4, and therefore the width of the foldable hanger 1 is reduced by approximately half. This position enables an easy hanging of the cloth through its neck opening on the hanger 1. The sliding-block guide 8 is in its open position and partially extends from the body 2. The flexible element 8.4 of the sliding-block guide 8 loosely leans on the wall of the body 2 and thus holds the sliding-block guide 8 in its open position. The arresting pin 7 is present at the free end of the guiding slot 8.1 and the relief 7.2 of the arresting pin 7 is released from the arresting groove 8.3 of the sliding-block guide 8, and it is positioned in the space 8.2 of the sliding-block guide 8 for free movement of the relief 7.2. In this position the hanger 1 is prepared for the hanging of cloth.

Example 3

Embodiments of foldable hangers according to the present disclosure may work as follows. The cloth hanged on the foldable hanger 1 according to this present teaching can be hanged without extension of its neck opening. It is possible to change the position of the movable arm 5 from its standard position to its folded position by one hand—one finger of the hand, in which a man holds the hanger 1.

Pressing of the arresting pin 7 mounted on the flexible element 8.4 slidable along the spike 6 results in the moving of the relief 7.2 of the arresting pin 7 out of the arresting groove 8.3 of the sliding-block guide 8 releasing the sliding-block guide 8, which sliding-block guide 8 is partially turned by the effect of the prestressed flexible element 8.4 in such a way that its part is moved out of the body 2, thus forming open position of the sliding-block guide 8. By this way the arresting pin 7, being mounted on the fixed spike 6, comes to the free end of the guiding slot 8.1, and the movable arm 5 is turning via the cogs 5.1 at the proximal end over the cogs 8.5 at the bottom end of the sliding-block guide 8 until it hits the firm arm 4.

After putting of the cloth on the hanger, a hand holding the foldable hanger 1 at the body 2 presses the part of the sliding-block guide 8 extending out of the body 2. This pressing acts against the flexible element 8.4 of the sliding-block guide 8, which flexible element 8.4 is deformed against the wall of the body 2 coming to the prestressed position, and the whole volume of the sliding-block guide 8 becomes accommodated in the body 2; the guiding slot 8.1 moves together with the sliding-block guide 8 until the shank 7.1 of the arresting pin 7 comes to the end of the guiding slot 8.1, where the arresting groove 8.3 is formed, and the relief 7.2 of the arresting pin 7 falls into the arresting groove 8.3 due to the flexible mounting of the arresting pin 7 on the spike 6. The movable arm 5 connected with the sliding-block guide 8 via the gearing is forced to turn until reaching the locked standard position. The locking of the standard position is achieved by the sinking of the relief 7.2 of the arresting pin 7 into the arresting groove 8.3 of the sliding-block guide.

The preferred embodiments of the disclosure have been described above to explain the principles of the invention and its practical application to thereby enable others skilled in the art to utilize the invention. However, as various modifications could be made in the constructions and methods herein described and illustrated without departing from the scope of the invention, it is intended that all matter contained in the foregoing description or shown in the accompanying drawings, including all materials expressly incorporated by reference herein, shall be interpreted as illustrative rather than limiting. Thus, the breadth and scope of the present invention should not be limited by the above-described exemplary embodiment but should be defined only in accordance with the following claims appended hereto and their equivalents.

The invention claimed is:

1. A foldable hanger containing a body equipped with a hanging element and one firm arm fixed to the body and one movable arm pivotably attached to the body, wherein the body further comprises:

a spike, an arresting pin adapted for operation by a user, mounted on the spike in a flexibly slidable manner for ensuring slidable movement of the arresting pin along the spike and for creating a continual force pushing the arresting pin off the spike, a sliding-block guide adapted for operation by the user, movably positioned in the body, wherein the sliding-block guide is adapted for a movement between an open position and a closed position and contains:

a guiding slot for accommodation of the shank of the arresting pin, a space for free movement of the relief of the arresting pin formed along an entire length of the guiding slot, an arresting groove adapted for accommodation of the relief of the arresting pin formed at a closed end of the guiding slot, a prestressed flexible element adapted to create a continual force moving the sliding-block guide to the open position, sliding-block guide cogs adapted for collaboration with cogs of the movable arm, wherein the arresting pin further comprises a shank having, at its bottom part, a relief adapted to fit into the arresting groove of the sliding-block guide;

wherein the movable arm is equipped with the cogs at its proximal end, which cogs are adapted for collaboration with the sliding-block guide cogs, and wherein the sliding-block guide is adapted for the movement between:

the closed position, in which the relief of the arresting pin is sunk in the arresting groove of the sliding-block guide, and the movable arm is in a standard position, arranged symmetrically to the firm arm, and the open position, in which the arresting pin is arranged at an entry of the guiding slot, and the relief of the arresting pin is out of the arresting groove in the space for free movement of the relief resulting in a movement of the sliding-block guide to the open position, in which the sliding-block guide is accessible for operation by the user and the movable arm is displaced from the standard position in the open position of the sliding-block guide.

2. The foldable hanger according to claim 1, wherein the firm arm forms an integral part of the body.

3. The foldable hanger according to claim 1, wherein the flexible element forms an integral part of the sliding-block guide.

4. The foldable hanger according to claim 1, wherein the flexible element is a steel or plastic spring, pushing spring, or traction string.

5. The foldable hanger according to claim 1, wherein the body is equipped with a cover.

6. The foldable hanger according to claim 5, wherein the body with the cover have in the closed position of the sliding-block guide a shape of a block or a flat block.

7. The foldable hanger according to claim 5, wherein the sliding-block guide comprises a side wall, which side wall is arranged in the body in such a way that in the closed position the side wall of the sliding-block guide is aligned with the cover, and in the open position the sliding-block guide partially projects from the body in order to enable the user to operate the sliding-block guide.

8. The foldable hanger according to claim 1, wherein the sliding-block guide comprises a side wall, which side wall is arranged in the body in such a way that in the closed position the side wall of the sliding-block guide is aligned with the body, and in the open position the sliding-block guide partially projects from the body in order to enable the user to operate the sliding-block guide.

9. The foldable hanger according to claim 1, wherein the firm arm and the movable arm have shapes adapted for a mutual engagement in the open position of the sliding-block guide.

10. The foldable hanger according to claim 1, wherein the sliding-block guide cogs are arch shaped.

11. The foldable hanger according to claim 1, wherein the cogs of the movable arm are arch shaped.

12. The foldable hanger according to claim 1, wherein the arresting pin is equipped with a head for operation by the user arranged in such a way that it is aligned with the body or cover.

13. The foldable hanger according to claim 1, wherein the guiding slot of the sliding-block guide is arch shaped.

14. The foldable hanger according to claim 1, wherein the sliding-block guide is pivotably positioned in the body.

15. The foldable hanger according to claim 1, wherein the sliding-block guide is slidably positioned in the body.

16. The foldable hanger according to claim 1, wherein the arresting pin is equipped with a head for operation by the user arranged in such a way that it extends from an opening for the arresting pin or it is slightly sunk in the body, but accessible for a finger of the user.

17. The foldable hanger according to claim 1, wherein the arresting pin is equipped with a head for operation by the user arranged in such a way that it is slightly sunk in the body but accessible for a finger of the user.

* * * * *